US009086718B2

(12) United States Patent
Lin

(10) Patent No.: US 9,086,718 B2
(45) Date of Patent: Jul. 21, 2015

(54) KEY MECHANISM WITH EASY ASSEMBLY

(71) Applicant: Wistron Corporation, New Taipei (TW)

(72) Inventor: Yu-Wei Lin, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 228 days.

(21) Appl. No.: 13/889,327

(22) Filed: May 7, 2013

(65) Prior Publication Data

US 2014/0013894 A1 Jan. 16, 2014

(30) Foreign Application Priority Data

Jul. 13, 2012 (TW) ..... 101125386 A

(51) Int. Cl.
*H01H 13/14* (2006.01)
*G05G 1/02* (2006.01)

(52) U.S. Cl.
CPC ..... *G05G 1/02* (2013.01); *Y10T 74/20396* (2015.01)

(58) Field of Classification Search
CPC . H01H 2003/145; H01H 3/125; H01H 3/122; H01H 13/705; H01H 13/7065; H01H 13/7073; H01H 13/88; H01H 13/38; B41J 5/10; G06F 3/02; G06F 1/1662
USPC ..... 200/344; 361/600
See application file for complete search history.

(56) References Cited

U.S. PATENT DOCUMENTS

| | | | | |
|---|---|---|---|---|
| 5,144,302 | A * | 9/1992 | Carter et al. | 341/20 |
| 6,448,520 | B1 * | 9/2002 | Inoue | 200/344 |
| 6,624,369 | B2 * | 9/2003 | Ito et al. | 200/344 |
| 6,805,505 | B2 * | 10/2004 | Horiuchi et al. | 400/472 |
| 6,861,603 | B1 * | 3/2005 | Wang | 200/344 |
| 8,581,127 | B2 * | 11/2013 | Jhuang et al. | 200/314 |
| 2004/0226248 | A1 | 11/2004 | Wu | |

FOREIGN PATENT DOCUMENTS

TW 200426661 12/2004

OTHER PUBLICATIONS

Office action mailed on Sep. 11, 2014 for the Taiwan application No. 101125386, filing date: Jul. 13, 2012, p. 1 line 1-14, p. 2-5 and p. 6 line 1-7.

* cited by examiner

*Primary Examiner* — Briggitte R Hammond
*Assistant Examiner* — Doblade Elliott
(74) *Attorney, Agent, or Firm* — Winston Hsu; Scott Margo

(57) ABSTRACT

A key mechanism includes a tray, at least one keycap, at least one supporting structure and an engaging component. The at least one keycap is disposed on a side of the tray. The at least one supporting structure is connected to the tray and the at least one keycap for supporting the at least one keycap on the tray. The engaging component is installed on the tray. The engaging component includes a pivoting portion and an engaging portion. The pivoting portion is pivoted to the at least one supporting structure, and the engaging portion engages into an opening on a casing as the tray is assembled on the casing, so as to fix the tray on the casing.

10 Claims, 8 Drawing Sheets

KEY MECHANISM WITH EASY ASSEMBLY

BACKGROUND OF THE DISCLOSURE

1. Field of the Disclosure

The present disclosure relates to a key mechanism, and more specifically, to a key mechanism with easy assembly and reworking capability.

2. Description of the Prior Art

Generally speaking, it usually utilizes screws with a keyboard fixing structure, such as a screw boss, a screw hole and so on, to assemble a keyboard on a notebook computer. As for the fixing mechanism with screws, it spends more manpower, working hours and cost using screws in a manufacturing process of the notebook computer. In addition, there are many tests for the notebook computer in the manufacturing process, so the screws needs to be disassembled to detach external components, such as a keyboard, from the notebook computer, so as to facilitate operators to repair inner parts of the notebook computer. As a result, it results in inconvenience of assembly. As for the fixing mechanism with resilient hooks, it needs to use a pointed object to pry the resilient hooks to detach the keyboard from the notebook computer, and it is easy to scratch appearance of the notebook computer in this detaching procedure, resulting in defective products. Moreover, the resilient hooks are often fixed on the casing in a heat melt manner, and it lacks of reworking capability. That is, if the resilient hooks are damaged in the assembly procedure, a whole structure component with the resilient hooks needs to be replaced, resulting in increase of the manufacturing cost. Therefore, it is an important issue of the notebook computer to design a key mechanism with easy assembly and reworking capability.

SUMMARY OF THE DISCLOSURE

The present disclosure is to provide a key mechanism with easy assembly and reworking capability to solve above problems.

According to the disclosure, a key mechanism includes a tray, at least one keycap, at least one supporting structure and an engaging component. The at least one keycap is disposed on a side of the tray. The at least one supporting structure is connected to the tray and the at least one keycap for supporting the at least one keycap on the tray. The engaging component is installed on the tray. The engaging component includes a pivoting portion and an engaging portion. The pivoting portion is pivoted to the at least one supporting structure, and the engaging portion engages into an opening on a casing as the tray is assembled on the casing, so as to fix the tray on the casing.

According to the disclosure, a sunken part is formed on the tray for containing the engaging component.

According to the disclosure, the at least one supporting structure includes a first supporting component and a second supporting component, and the first supporting component and the second supporting component are pivotally connected to each other, so as to form a scissor structure.

According to the disclosure, an end of the first supporting component is pivotally connected to the tray, the other end of the first supporting component is pivotally connected to the keycap, an end of the second supporting component is pivotally connected to the tray and the pivoting portion of the engaging component, and the other end of the second supporting component is pivotally connected to the keycap, so that the pivoting portion of the engaging component pivots relative to the second supporting component as the keycap pivots relative to the first supporting component and the second supporting component, so as to separate the engaging portion of the engaging component from the opening of the casing.

According to the disclosure, the pivoting portion of the engaging component is a slotted structure, and the other end of the second supporting component is pivotally installed inside the slotted structure.

According to the disclosure, the pivoting portion of the engaging component is pivotally connected to the other end of the second supporting component in a clamping manner.

According to the disclosure, the at least one keycap includes two keycaps, the at least one supporting structure includes two supporting structures for supporting the two keycaps on the tray respectively, each supporting structure includes a first supporting component and a second supporting component, and the first supporting component and the second supporting component are pivotally connected to each other to form a scissor structure.

According to the disclosure, an end of the first supporting component of each supporting structure is pivotally connected to the tray, the other end of the first supporting component of each supporting structure is pivotally connected to the keycap, an end of the second supporting component of each supporting structure is pivotally connected to the tray and two ends of the pivoting portion of the engaging component, the other end of the second supporting component of each supporting structure is pivotally connected to the keycap, so that the pivoting portion of the engaging component pivots relative to the second supporting component of each supporting structure as the two keycaps simultaneously pivot relative to the corresponding supporting structures respectively, so as to separate the engaging portion of the engaging component from the opening of the casing.

According to the disclosure, an inclined structure is formed on an end of the engaging portion of the engaging component, for guiding the engaging portion to engage into the opening of the casing.

According to the disclosure, the key mechanism further includes a resilient component disposed between the tray and the keycap, and the keycap being for driving the resilient component to contact the tray as being pressed downward.

The key mechanism of the present disclosure utilizes the engaging component pivotally connected to the scissor structure for supporting the keycap to fix the tray on the casing, so it does not need screws with the keyboard fixing structure, such as a screw boss, a screw hole and so on, to fix the keyboard on the casing, or fix the keyboard with the resilient hook on the casing. As a result, it can increase convenience of assembly and yield rate of assembly and can decrease the manufacturing cost. And even when the engaging component for fixing the tray is broken, it only needs to replace with the new key mechanism corresponding to the single key, instead of replacing the whole new structure component in the prior art. Therefore, the present disclosure also has reworking capability.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
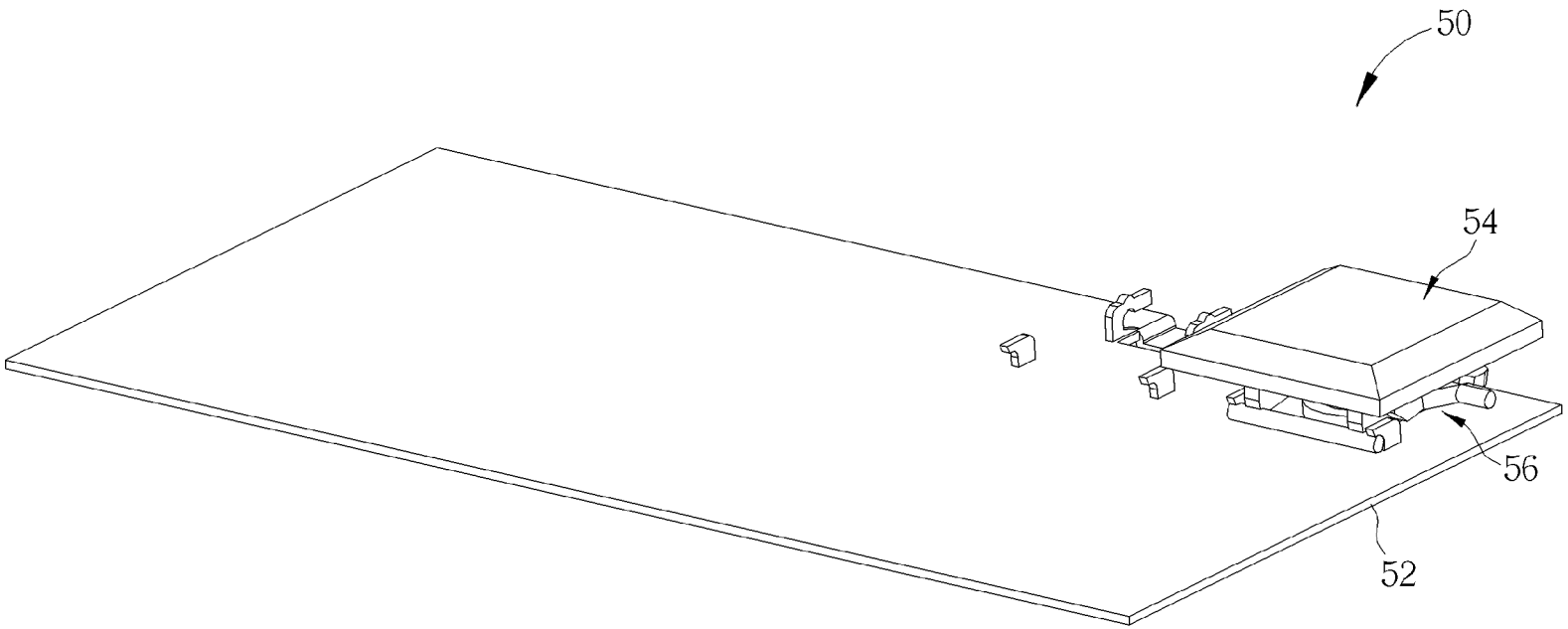
FIG. 1 and FIG. 2 are respectively an assembly diagram and an exploded diagram of a key mechanism according to an embodiment of the present disclosure.
Figure 2:
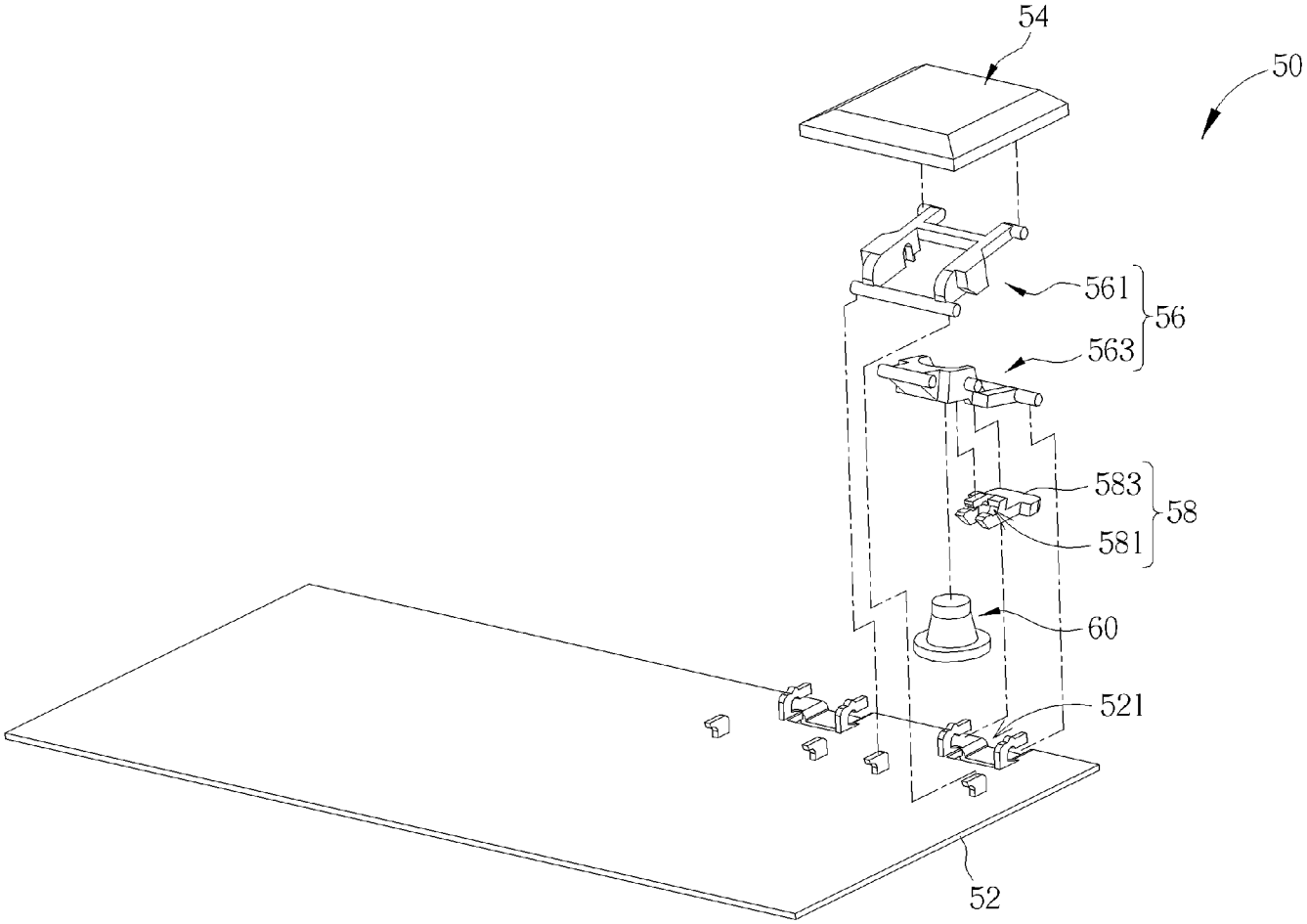

Please refer to FIG. 1 and FIG. 2. FIG. 1 and FIG. 2 are respectively an assembly diagram and an exploded diagram of a key mechanism 50 according to an embodiment of the present disclosure. The key mechanism 50 can be installed on a computer host device, such as a notebook computer, and users can press the key mechanism 50 to generate a corresponding key signal. The key mechanism 50 includes a tray 52, at least one keycap 54, at least one supporting structure 56, an engaging component 58 and a resilient component 60. The tray 52 can be a metal plate whereon a switch component (not shown in figures) is disposed. The keycap 54 is disposed on a side of the tray 52 and is for users to press. The supporting structure 56 is connected to the tray 52 and the keycap 54, and the supporting structure 54 is for supporting the keycap 54 on the tray 52, so that the keycap 54 can move upward and downward relative to the tray 52. For example, the supporting structure 56 can include a first supporting component 561 and a second supporting component 563, and the first supporting component 561 and the second supporting component 563 are pivotally connected to each other, so as to form a scissor structure for adjusting a height of the keycap 54.

Figure 3:
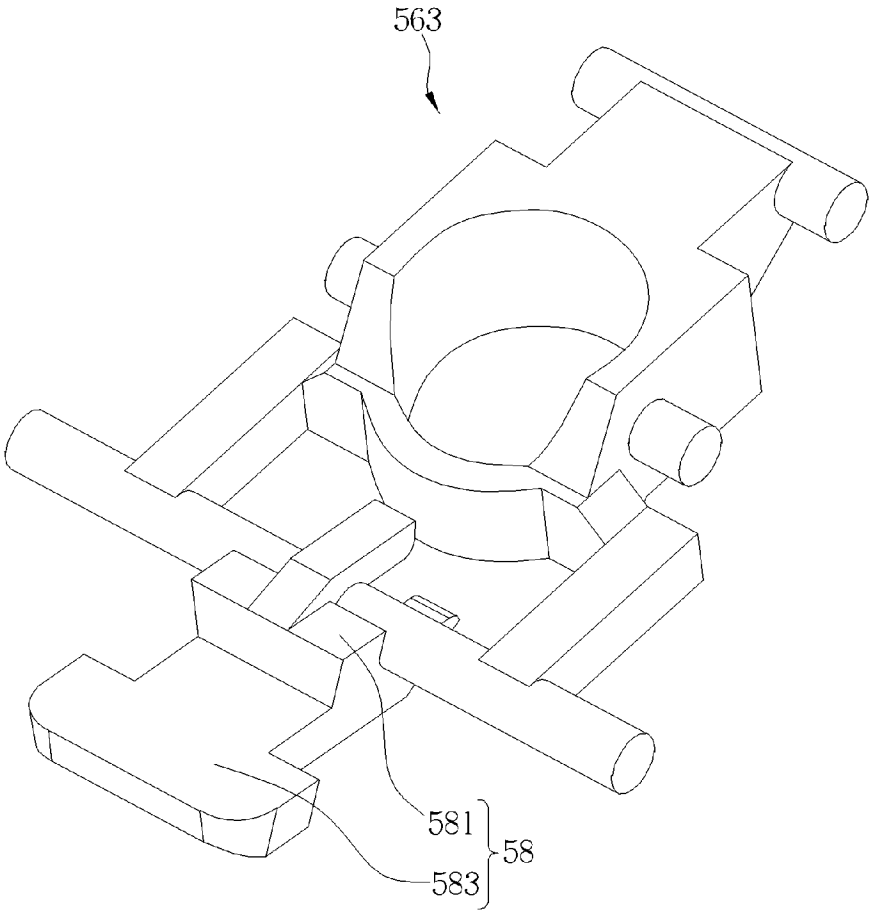
FIG. 3 is a diagram of combination of a second supporting component and an engaging component according to another embodiment of the present disclosure.

In addition, the engaging component 58 is installed on the tray 52, and the engaging component 58 includes a pivoting portion 581 and an engaging portion 583. An end of the first supporting component 561 is pivotally connected to the tray 52, the other end of the first supporting component 561 is pivotally connected to the keycap 54. An end of the second supporting component 563 is pivotally connected to the tray 52 and the pivoting portion 581 of the engaging component 58, and the other end of the second supporting component 563 is pivotally connected to the keycap 54. The pivoting portion 581 of the engaging component 58 can be a slotted structure, and the other end of the second supporting component 563 can be pivotally installed inside the slotted structure. A pivotal connection of the second supporting component 563 and the engaging component 58 is not limited to this embodiment. For example, please refer to FIG. 3. FIG. 3 is a diagram of combination of the second supporting component 563 and the engaging component 58 according to another embodiment of the present disclosure. In this embodiment, the pivoting portion 581 of the engaging component 58 is pivotally connected to the other end of the second supporting component 563 in a clamping manner. That is, any mechanism for pivoting the second supporting component 563 with the engaging component 58 is within the scope of the present disclosure. Moreover, the resilient component 60 can be a rubber dome and disposed between the tray 52 and the keycap 54. The keycap 54 is for deforming the resilient component 60 to contact the switch component on the tray 52 as being pressed downward, so as to generate the corresponding key signal. Besides, a sunken part 521 is formed on the tray 52 for containing the engaging component 58, and a structure with an inclined angle of the sunken part 521 can assist the engaging component 58 to rotate.

Figure 4:
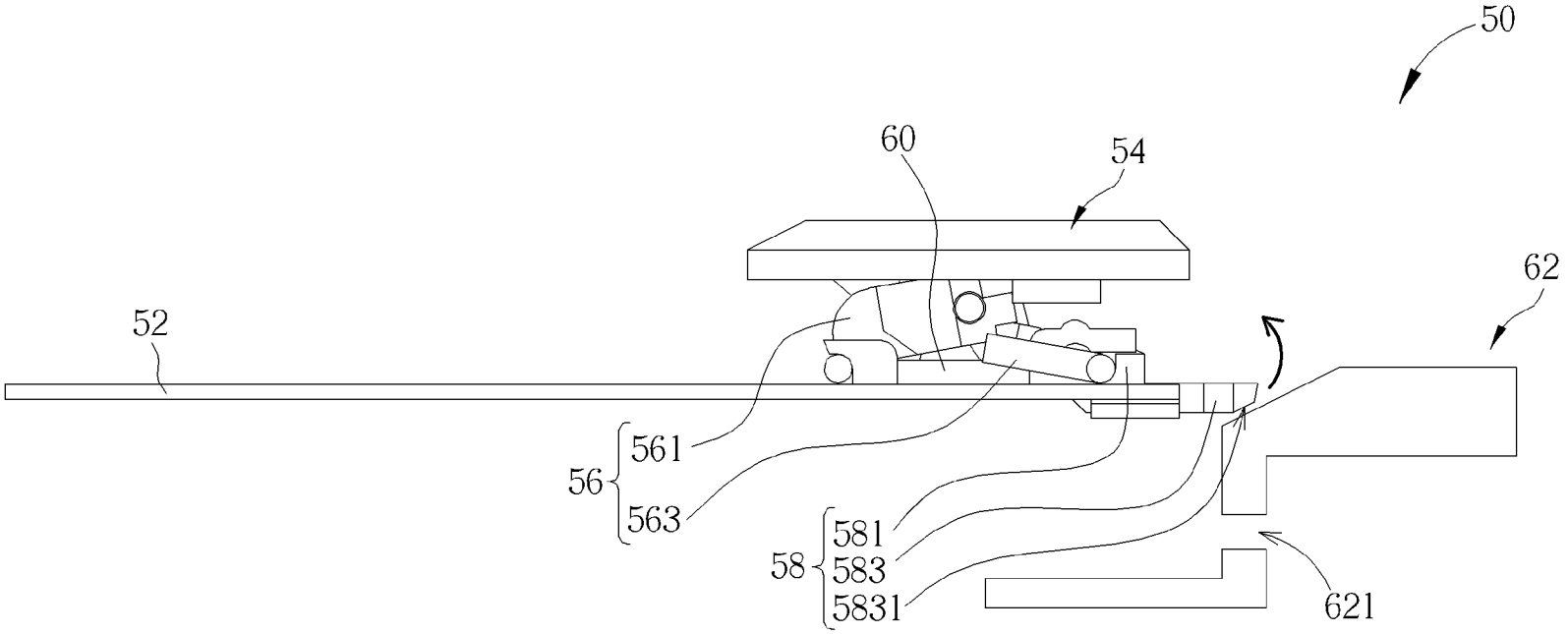
FIG. 4 to FIG. 6 are assembly diagrams of the key mechanism according to the embodiment of the present disclosure.
Figure 5:
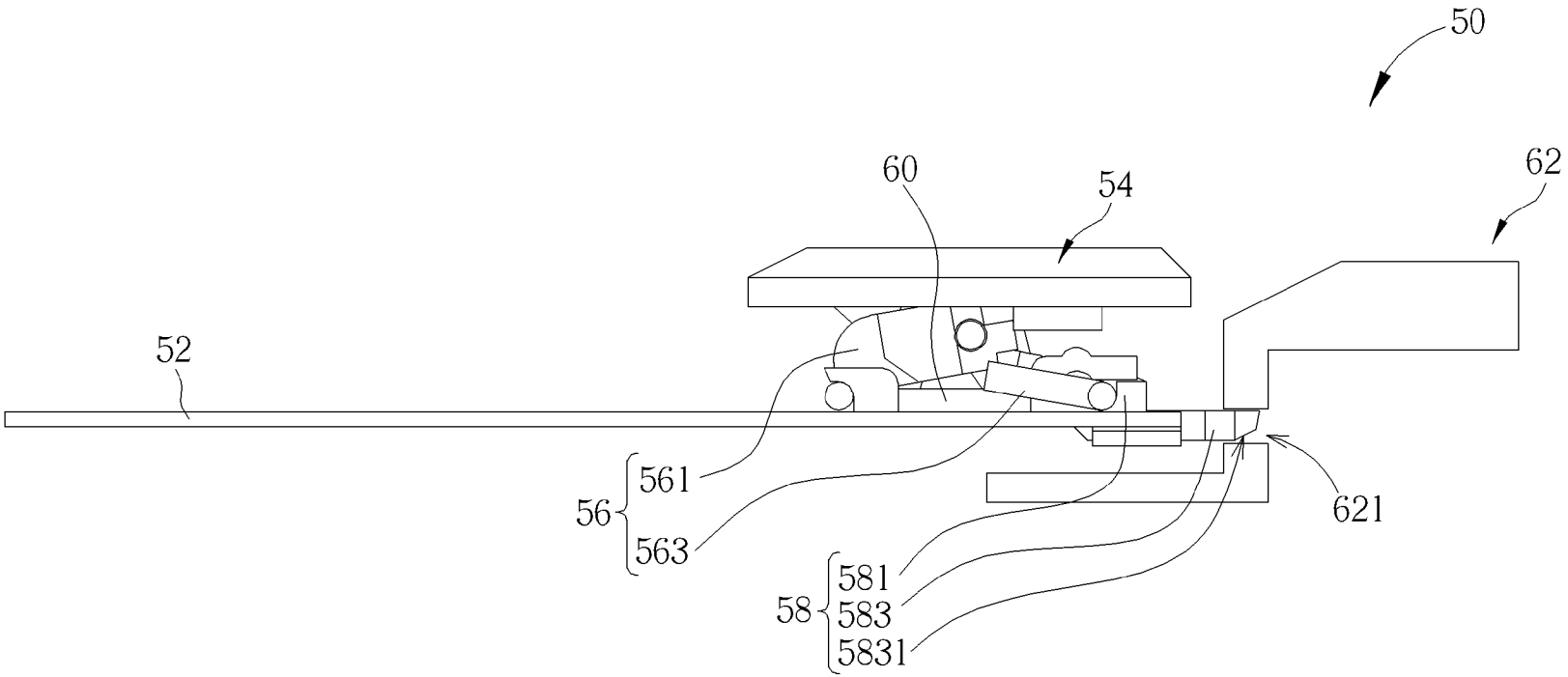
Figure 6:
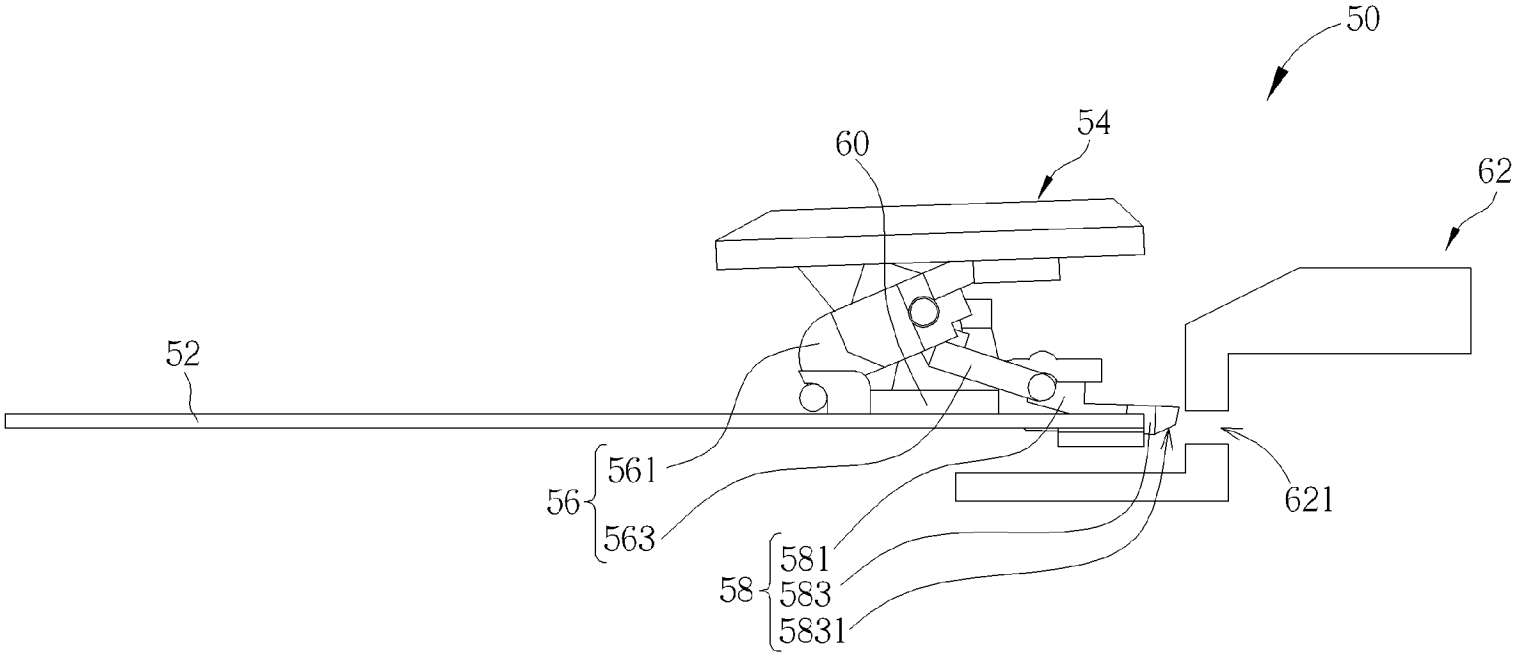

Please refer to FIG. 4 to FIG. 6. FIG. 4 to FIG. 6 are assembly diagrams of the key mechanism 50 according to the embodiment of the present disclosure. When the tray 52 is about to install on a casing 62, the engaging portion 583 of the engaging component 58 will contact the casing 62 first, so that the engaging component 58 pivots relative to the casing 62 in a counterclockwise direction of an arrow as shown in FIG. 4 until a bottom side of the tray 52 reaches to a bottom of the casing 62, and then the casing 62 does not contact against the engaging portion 583 of the engaging component 58. As shown in FIG. 5, the engaging portion 583 of the engaging component 58 will rotate to engage into an opening 621 on the casing 62, so as to fix the tray 52 on the casing 62 and achieve assembly of the key mechanism 50 on the casing 62. An inclined structure 5831 is formed on an end of the engaging portion 583 of the engaging component 58, for guiding the engaging component 58 to pivot relative to the casing 62 and guiding the engaging portion 583 to engage into the opening 621 of the casing 62. On the contrary, when the key mechanism 50 is about to detach from the casing 62, as shown in FIG. 6, the keycap 54 can be pulled upward, so that the keycap 54 pivots relative to the first supporting component 561 and the second supporting component 563. The keycap 54 can be designed with a pre-bent structure, so that it only needs to pull the keycap 54 upward to drive the keycap 54 back obliquely, so as to increase convenience of detachment. At this time, the pivoting portion 581 of the engaging component 58 is driven to pivot relative to the second supporting component 563 clockwise, so as to separate the engaging portion 583 of the engaging component 58 from the opening 621 of the casing 62. The sunken part 521 of the tray 52 with the structure with the inclined angle can guide the engaging portion 583 to pivot smoothly, and the inclined structure 5831 can also guide the engaging portion 583 to separate from the opening 621 of the casing 62. And then the key mechanism 50 can be detached from the casing 62.

From the above, the present disclosure utilizes the engaging component pivotally connected to the scissor structure for supporting the keycap to fix the tray on the casing, so it does not need screws with a keyboard fixing structure, such as a screw boss, a screw hole and so on, to fix the keyboard on the casing, or fix the keyboard with the resilient hook on the casing. As a result, it can increase convenience of assembly and yield rate of assembly and can decrease the manufacturing cost. And when the engaging component for fixing the tray is broken, it only needs to replace with a new key mechanism corresponding to a single key, instead of replacing with a whole new structure component in the prior art. Therefore, the present disclosure also has reworking capability. Amounts and positions of the engaging components for engaging with the casing are not limited to above embodiments. For example, multiple engaging components can be respectively disposed under a plurality of keycaps, so as to enhance bonding strength between the tray and the casing, and it depends on practical design demand.

Figure 7:
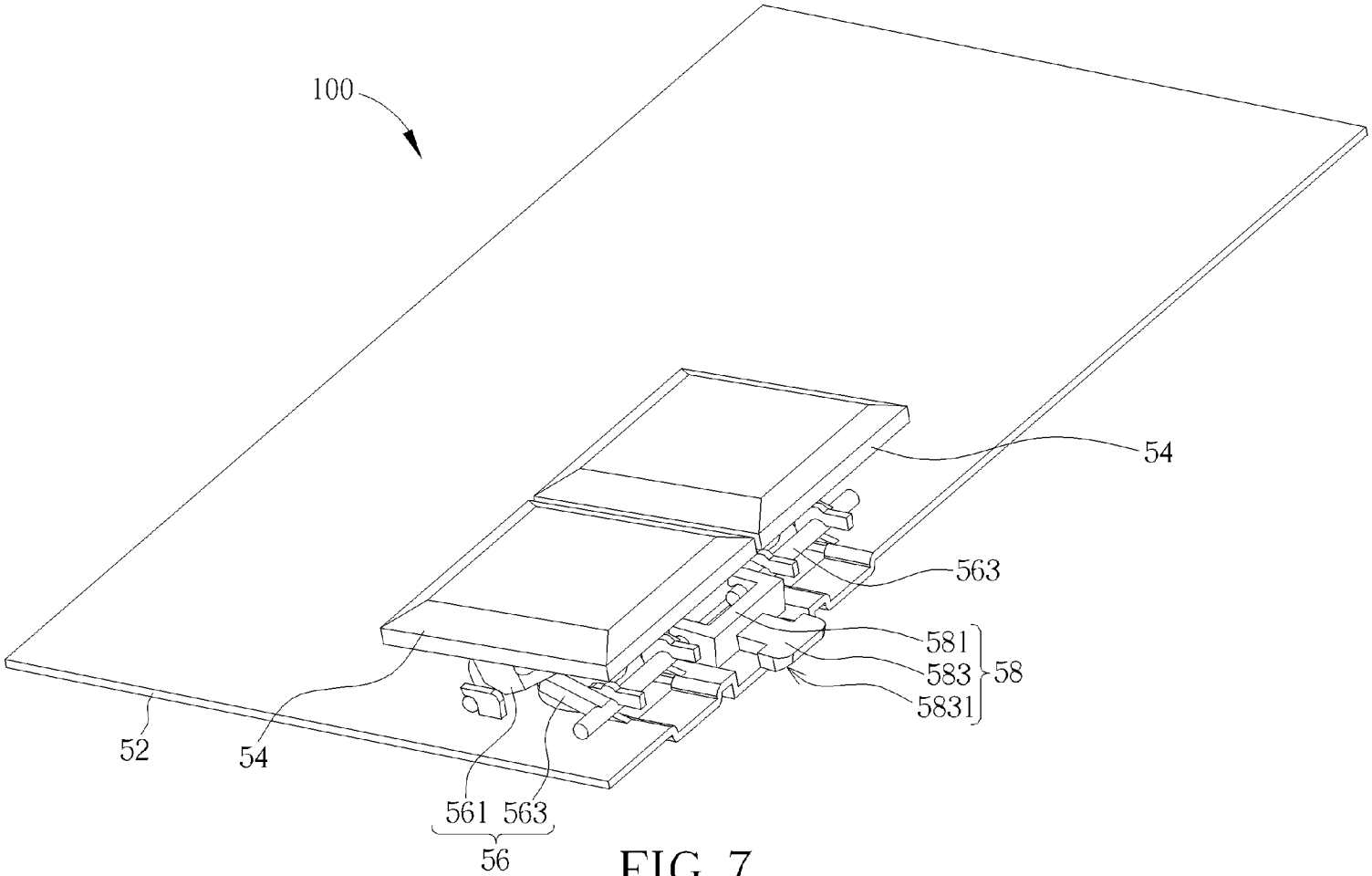
FIG. 7 is a diagram of a key mechanism according to another embodiment of the present disclosure.
Figure 8:
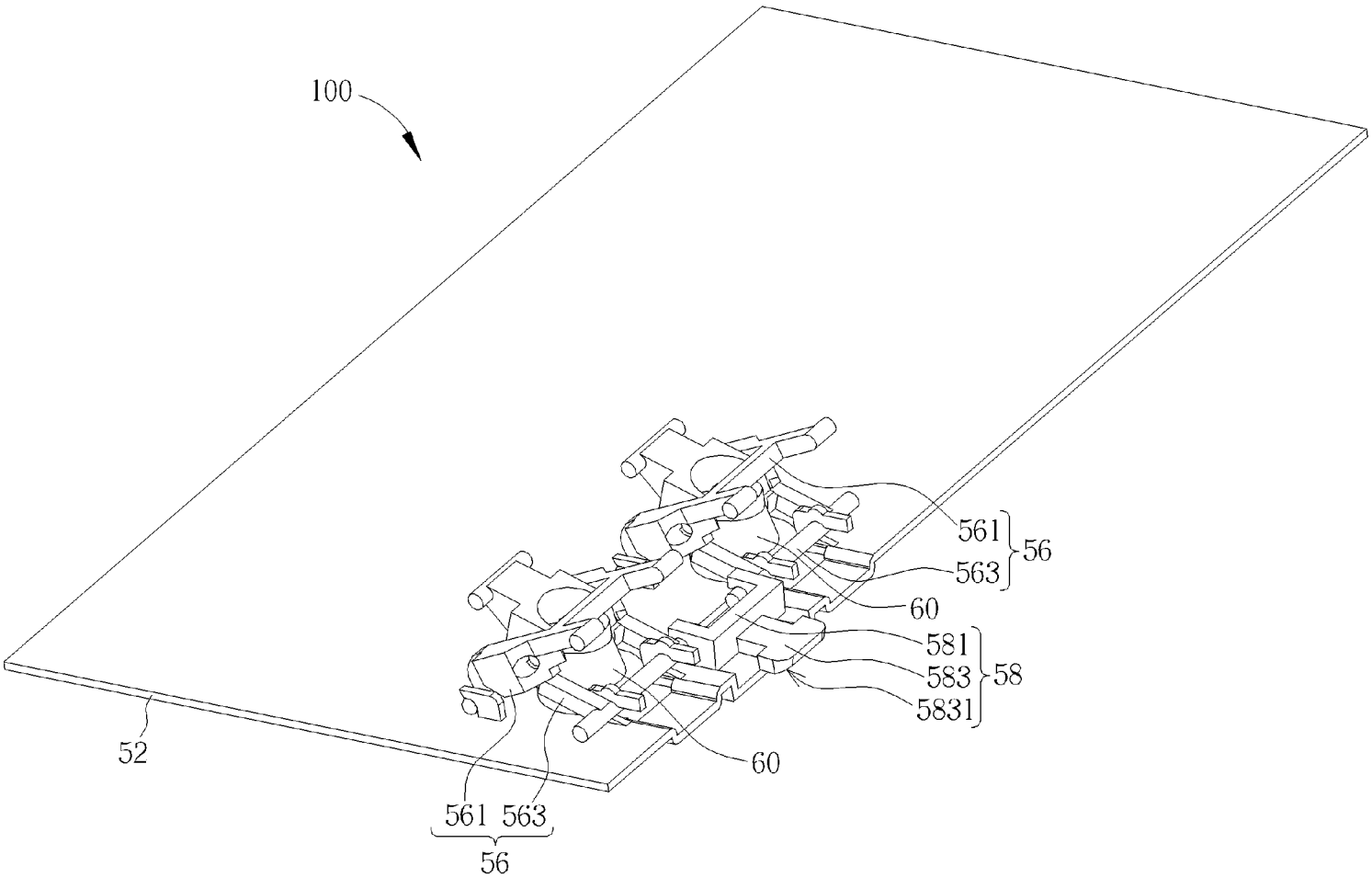
FIG. 8 is a partial structural diagram of the key mechanism according to another embodiment of the present disclosure.

Moreover, it also can be designed that a combination of multiple keys shares a single engaging component in the present disclosure. Please refer to FIG. 7 and FIG. 8. FIG. 7 is a diagram of a key mechanism 100 according to another embodiment of the present disclosure. FIG. 8 is a partial structural diagram of the key mechanism 100 according to another embodiment of the present disclosure. In order to show inner components of the key mechanism 100 clearly, two keycaps 54 are omitted to illustrate in FIG. 8. A difference between this embodiment and previous embodiments is that the key mechanism 100 includes two keycaps, two supporting structures 56, and two resilient components 60. Each supporting structure 56 is for supporting the corresponding keycap 54 on the tray 52. Each resilient component 60 is disposed between the tray 52 and the corresponding keycap 54. Each supporting structure 56 includes the first supporting component 561 and the second supporting component 563, and the first supporting component 561 and the second supporting component 563 are pivotally connected to each other, so as to form a scissor structure to adjust the height of the keycap 54. In addition, an end of the first supporting component 561 of each supporting structure 56 is pivotally connected to the tray 52, and the other end of the first supporting component 561 of each supporting structure 56 is pivotally connected to the corresponding keycap 54. An end of the second supporting component 563 of each supporting structure 56 is pivotally connected to the tray 52 and two ends of the pivoting portion 581 of the engaging component 58, and the other end of the second supporting component 563 of each supporting structure 56 is pivotally connected to the corresponding keycap 54. Similar to an operation principle of the previous embodiment, the engaging portion 583 of the engaging component can also rotate to engage into the opening 621 of the casing 62 as shown in FIG. 5, so as to fix the tray 52 on the casing 62. However, in this embodiment, when the key mechanism is about to detach from the casing 62, the two keycaps 54 need to be pulled upward at the same time, so that the two keycaps 54 respectively pivot relative to the first supporting components 561 and the second supporting components 563 of the corresponding supporting structures 56 simultaneously. As a result, the pivoting portion 581 of the engaging component 58 connected to the two second supporting components 563 can pivot, so that the engaging portion 583 of the engaging component 58 is detached from the opening 621 of the casing 62, and then the key mechanism 100 can be detached from the casing 62. That is, in this embodiment, the two keycaps 54 need to be pulled at the same time to release constraint between the engaging component 58 and the casing 62. Therefore, it can prevent a misoperation of detaching the tray 52 as users pull the single keycap 54 accidentally.

In contrast to the prior art, the key mechanism of the present disclosure utilizes the engaging component pivotally connected to the scissor structure for supporting the keycap to fix the tray on the casing, so it does not need screws with the keyboard fixing structure, such as a screw boss, a screw hole and so on, to fix the keyboard on the casing, or fix the keyboard with the resilient hook on the casing. As a result, it can increase convenience of assembly and yield rate of assembly and can decrease the manufacturing cost. And even when the engaging component for fixing the tray is broken, it only needs to replace with the new key mechanism corresponding to the single key, instead of replacing the whole new structure component in the prior art. Therefore, the present disclosure also has reworking capability.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A key mechanism, comprising:

a tray;

at least one keycap disposed on a side of the tray;

at least one supporting structure connected to the tray and the at least one keycap, the at least one supporting structure being for supporting the at least one keycap on the tray; and an engaging component installed on the tray and linked with the at least one supporting structure, the engaging component comprising:

a pivoting portion pivoted to the at least one supporting structure; and an engaging portion connected to the pivoting portion and engaged into an opening on a casing as the tray is assembled on the casing, so as to fix the tray on the casing, the at least one keycap driving the at least one supporting structure to drive the pivoting portion to pivot relative to the at least one supporting structure, so as to separate the engaging portion from the opening of the casing.

2. The key mechanism of claim 1, wherein a sunken part is formed on the tray for containing the engaging component.

3. The key mechanism of claim 1, wherein the at least one supporting structure comprises a first supporting component and a second supporting component, and the first supporting component and the second supporting component are pivotally connected to each other, so as to form a scissor structure.

4. The key mechanism of claim 3, wherein an end of the first supporting component is pivotally connected to the tray, the other end of the first supporting component is pivotally connected to the keycap, an end of the second supporting component is pivotally connected to the tray and the pivoting portion of the engaging component, and the other end of the second supporting component is pivotally connected to the keycap, so that the pivoting portion of the engaging component pivots relative to the second supporting component as the keycap pivots relative to the first supporting component and the second supporting component, so as to separate the engaging portion of the engaging component from the opening of the casing.

5. The key mechanism of claim 4, wherein the pivoting portion of the engaging component is a slotted structure, and the other end of the second supporting component is pivotally installed inside the slotted structure.

6. The key mechanism of claim 4, wherein the pivoting portion of the engaging component is pivotally connected to the other end of the second supporting component in a clamping manner.

7. The key mechanism of claim 1, wherein the at least one keycap comprises two keycaps, the at least one supporting structure comprises two supporting structures for supporting the two keycaps on the tray respectively, each supporting structure comprises a first supporting component and a second supporting component, and the first supporting component and the second supporting component are pivotally connected to each other to form a scissor structure.

8. The key mechanism of claim 7, wherein an end of the first supporting component of each supporting structure is pivotally connected to the tray, the other end of the first supporting component of each supporting structure is pivotally connected to the keycap, an end of the second supporting component of each supporting structure is pivotally connected to the tray and two ends of the pivoting portion of the engaging component, the other end of the second supporting component of each supporting structure is pivotally connected to the keycap, so that the pivoting portion of the engaging component pivots relative to the second supporting component of each supporting structure as the two keycaps simultaneously pivot relative to the corresponding supporting structures respectively, so as to separate the engaging portion of the engaging component from the opening of the casing.

9. The key mechanism of claim 1, wherein an inclined structure is formed on an end of the engaging portion of the engaging component, for guiding the engaging portion to engage into the opening of the casing.

10. The key mechanism of claim 1, further comprising a resilient component disposed between the tray and the keycap, and the keycap being for driving the resilient component to contact the tray as being pressed downward.

* * * * *